United States Patent [19]

Francois et al.

[11] Patent Number: 4,973,388

[45] Date of Patent: Nov. 27, 1990

[54] METHOD OF DEPOSITING A DECORATIVE WEAR-RESISTANT COATING LAYER ON A SUBSTRATE

[75] Inventors: Aubert François, Le Locle; Miremad Bahman, Neuchatel, both of Switzerland

[73] Assignee: Preci-Coat S.A., La Chaux-De-Fonds, Switzerland

[21] Appl. No.: 113,284

[22] PCT Filed: Feb. 3, 1987

[86] PCT No.: PCT/CH87/00014

§ 371 Date: Oct. 2, 1987

§ 102(e) Date: Oct. 2, 1987

[87] PCT Pub. No.: WO87/04812

PCT Pub. Date: Aug. 13, 1987

[30] Foreign Application Priority Data

Feb. 4, 1986 [CH] Switzerland ..... 00416/86

[51] Int. Cl.[5] ..... G04B 37/22; C23C 28/00

[52] U.S. Cl. ..... 204/38.4; 204/38.1; 204/192.16; 204/192.31

[58] Field of Search ..... 204/192.16, 192.15, 204/192.31, 38.1, 38.4; 428/621, 627, 628, 629, 632

[56] References Cited

U.S. PATENT DOCUMENTS 3,900,592 3/1975 Kennedy et al. ..... 427/39
4,212,708 7/1980 Smagunova et al. ..... 204/47.5
4,252,862 2/1981 Nishida ..... 428/457
4,591,418 5/1986 Snyder ..... 204/192.16
4,737,252 4/1988 Hoffman ..... 204/192.16

FOREIGN PATENT DOCUMENTS 52-21283 2/1977 Japan ..... 204/192.16
1555467 11/1979 United Kingdom .

OTHER PUBLICATIONS

D. M. Mattox, Fundamentals of Ion Plating, *J. Vac. Sci. Technol.*, vol. 10, No. 1, Jan./Feb. 1973, pp. 47–52.
Brian Chapman, Glow Discharge Processes, John Wiley & Sons, New York, 1980, pp. 215–237, 276–283.
Patent Abstracts of Japan, vol. 7, No. 225 (C-189) (1370) 10/1983, Abstracting 58-120777.

*Primary Examiner*—T. Tung
*Assistant Examiner*—William T. Leader
*Attorney, Agent, or Firm*—Frost & Jacobs

[57] ABSTRACT

A method for depositing a wear-resistant decorative coating on a substrate, comprising a first stage of vacuum deposition on the surface of the substrate of a layer of at least one metal of the group titanium, zirconium, hafnium, vanadium, niobium, tantalum, chromium, molybedenum, tungsten and aluminium, to which is added at least one element of the group carbon, nitrogen, oxygen, boron, silicon, fluorine, chlorine, sulfur and phosphorus; a second stage including activation of the first layer by ionic bombardment under vacuum conditions and simultaneous deposition of a second fine layer of a metal or metal alloy; and a third stage involving galvanic deposition of a third layer of a decorative metal coating over the second layer.

6 Claims, 2 Drawing Sheets

METHOD OF DEPOSITING A DECORATIVE WEAR-RESISTANT COATING LAYER ON A SUBSTRATE

BACKGROUND OF THE INVENTION

The present invention relates to a method of depositing a decorative wear-resistant coating layer on a substrate, said substrate constituting at least a part of a decorative and/or utilitarian article.

The expressions "decorative metallic coating" and "metal having decorative properties" are commonly used in the art to designate metallic layers having a brilliant or polished appearance and a resistance to tarnishing and corrosion which are particularly appreciated and appropriate for use in decorative applications.

It also relates to decorative or utilitarian articles made by this method, in which esthetic appearance is important.

It is very often required that the surfaces of decorative articles have a golden colour. When these articles are not of solid gold, but are fabricated from a non-noble metal such as brass, stainless steel, zinc, etc. one may obtain this golden appearance by applying a surface layer of gold or a gold alloy, most frequently by electroplating. If it is desired that this coating be resistant to wear and to corrosion, its thickness must at least attain 10 micron.

To this end, an undercoating is generally electroplated, which is formed of a 14 to 18 carat precious metal alloy. But the corrosion resistance of these alloys is often insufficient, and their colour does not correspond exactly to the colours of solid alloys, such as those defined for example by the standards of the Swiss Watchmaking Industry NIHS 03-50 (1N14, 2N18, 3N, 4N, 5N alloy).

The corrosion resistance of gold platings, and also their colour, may be improved by electroplating a surface layer of gold alloy having a purity higher than or equal to 22 carats, and corresponding exactly to the desired colour.

Given the high price of gold, and its low resistance to wear, it has been sought to replace gold platings by hard coatings deposited under vacuum, or by vapour phase deposition. For example, titanium nitride coatings are generally applied, which are deposited by chemical vapour phase reaction, reactive evaporation, ion projection or cathodic sputtering, on decorative articles of metal, sintered metal carbides or nitrides, or ceramic material. These coatings have the advantage of being resistant to wear and having a golden appearance.

However, the colour obtained with these methods is only approximately that of gold, and a trained eye easily detects the difference. This lack of equivalence will be pointed out hereinafter with reference to FIGS. 2 to 5.

On the other hand, obtaining very dense and corrosion-resistant titanium nitride coatings by ion projection or cathodic sputtering, entails very high compression stress states in the layer, and consequently shear stresses between the layer and the base material which favour separation of the coating.

For an antiwear application, it is proposed in U.S. Pat. No. 3,857,682 to deposit under vacuum a fine gold layer on top of titanium nitride. This idea has been taken up in U.S. Pat. No. 4,252,862 and Swiss Pat. No. 631,040, applied to the field of decoration, with the object of giving the titanium nitride surface the exact colour of gold, or of a gold alloy. During utilization of an article thus coated, the wear of the gold coating occurs only at the sharp edged angles and makes apparent the colour of titanium nitride, whose colour is slightly distinguishable from the remainder of the coating.

To improve the brillance and colour conformity of titanium nitride coatings, Japanese publication No. 58.153.766 and European publication No. 38.294, describe a method of conjugated deposition of titanium nitride and gold, for forming on the whole or a part of the coating thickness a titanium nitride/gold compound. This procedure nevertheless seems to pose corrosion problems, and the colour obtained is also away from the standard colours of golden coatings.

Finally, the successive deposition of thin layers of titanium nitride and gold, by a vacuum process, also improves the brilliance of the coating.

All of these known methods unfortunately have as principal defects:

The risk of coating separation induced by shear stresses at the surface of contact of the titanium nitride and the base material.

Random, often poor adherence of gold on titanium nitride, except in the case of simultaneous deposition of titanium nitride and gold.

The difficulty of obtaining a standard colour by vacuum deposition, and especially of varying the colour as a function of the utilizers' demands, while the methods of depositing gold or gold alloy do not enable varying the final colour of the coating from one treatment to the other.

SUMMARY OF THE INVENTION

In the present invention, it is proposed to reduce these different difficulties and in particular to enable to considerably improve the resistance to wear, adherence and appearance of a deposit based on titanium nitride with a final gold coating.

This object is achieved by the method according to the invention, characterized in that during a first stage, vacuum deposition is effected on the surface of the substrate, of at least one metal selected from the group consisting of: titanium, zirconium, hafnium, vanadium, niobium, tantalum, chromium, molybdenum, tungsten, aluminium, to which at least one element is added, which is selected from the group consisting of: carbon, nitrogen, oxygen, boron, silicon, fluorine, chlorine, sulfur, phosphorus, in that, during a second stage, this first layer is activated by ion bombardment under vacuum, and a second thin layer of a metal and/or a metallic alloy is deposited, at least partly simultaneously, and in that during a third stage, a third decorative metallic coating layer is electroplated on said second layer.

BRIEF DESCRIPTION OF THE DRAWINGS

The present invention will be better understood with reference to the description of examples of embodiments and to the accompanying drawings wherein.

DETAILED DESCRIPTION OF THE INVENTION

Figure 1:
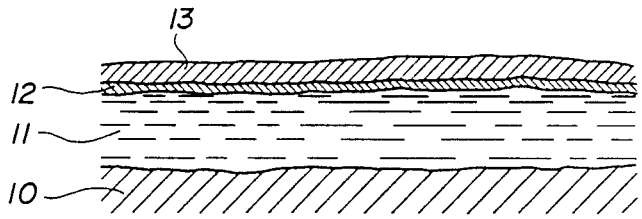
FIG. 1 represents a schematic view illustrating the different phases of the method according to the invention.

According to a particularly interesting embodiment, the described method consists in depositing under vacuum, for example by cathodic sputtering, by vacuum evaporation, or by ion projection, titanium in presence of nitrogen at the surface of a metallic or non metallic article 10 schematically represented in FIG. 1. During this deposition, the amount of nitrogen introduced into the treatment chamber varies continously from zero to a value defined by the desired result, in such a manner that the composition of the coating 11, starting from the bare surface of the article, varies progressively from pure titanium to titanium nitride having an approximately stoichiometric composition.

According to a particularly advantageous technique, the electric polarisation of the treated article is simultaneously varied, so as to progressively vary the mechanical compression stresses from a minimum value at the start of coating to a maximum value at the end of coating. One obtains in this manner a coating which, starting from the bare surface of the article, has a given gradient of nitrogen concentration and of mechanical stress. The coating obtained thereby has minimum shear stresses at the surface of contact of the article with the coating, as well as the desired optical, mechanical and anticorrosive properties.

After deposition of the first layer of titanium nitride, the method provides for preparing the top surface of this layer so as to render it more fit to subsequently receive a layer of gold or gold alloy, deposited by electroplating, having the desired final colour, as close as possible to a standard colour defined by the usual norms. To this end, an activation of the titanium nitride surface by intense ion bombardment is effected during a first stage of the second treatment phase. After this first treatment stage, the deposition of gold atoms, forming an intermediate layer 12, is effected, during a second stage of this second treatment phase. This deposition of gold atoms is effected under vacuum by evaporation, by ion projection or by cathodic sputtering, while continuing to effect ion bombardment of the titanium nitride surface. During this second stage, the strength of the ion bombardment is progressively reduced.

When this operation is achieved, the activated titanium nitride surface is ready to receive a layer 13 of pure gold or a gold alloy of high purity, deposited by electroplating, enabling to provide it with the desired colour. This colour can be modified at will by changing the composition of the electroplating bath or by modifying the process parameters defining the electroplating conditions. In this manner, different articles of the same batch, previously coated with a titanium nitride undercoating, then with a second thin gold layer, by a vacuum deposition method, may be coated with a final layer having different shades depending on the electroplating bath in which they have been respectively treated or on treatment conditions which have been modified.

The example of the embodiment described above, providing for applying a titanium nitride undercoating on an article, next depositing a thin gold layer by vacuum deposition, then effecting electroplating of this same metal, may be readily generalized and applied to different other metals.

The undercoating which may have a thickness lying between 0.1 and 20 micron, may be produced by vacuum deposition of at least one of the following metals: titanium, zirconium, hafnium, vanadium, niobium, tantalum, chromium, molybdenum, tungsten, aluminium. This deposition may be effected in presence of one of the following elements: carbon, nitrogen, oxygen, boron, silicon, fluorine, chlorine, sulphur, phosphorus. As with titanium nitride, the proportion of these elements is increased progressively during the phase of vacuum deposition of the previously mentioned metals.

At the same time, as the coating thickness increases, the articles to be treated are polarized more and more negatively. This enables to obtain a coating having an increasing concentration of non metallic elements and having increasing mechanical stress states.

During a second phase of the method, intense ionic cleaning is effected, and a second thin metallic layer is deposited, partly simultaneously, which may be of gold or a gold alloy, but also of one or several precious metals such as for example platinum, palladium, rhodium, silver, iridium, osmium, rhenium and ruthenium. This second layer preferably has a thickness lying between 100 and 10,000 Å.

The final layer is next deposited by electroplating on the metallic coating constituting the second layer. This electroplating is in general of gold or a high-carat gold alloy, for example a gold alloy of at least 22 carats comprising, as alloying element, indium, nickel, cobalt, cadmium, copper, silver, palladium, zinc or antimony. However, this deposit may also be formed of one or more precious metals such as platinum, palladium, rhodium, silver, iridium, osmium, rhenium or ruthenium, or an alloy of one of these metals with one or several other metals, or possibly of a non-precious metal or alloy.

The thickness of the surface layer, obtained by electroplating under clearly defined conditions enabling to obtain the desired shade and appearance, preferably lies between 0.1 and 30 micron.

The method enables treating the surface of an article so as to cover it with a hard adherent and corrosion resistant layer having approximately the desired colour, and then producing on this undercoating a final coating having exactly the desired colour and adhering perfectly to this undercoating.

Various articles may be treated in this manner. For example a watch case of stainless steel, previously degreased and dried, is placed in a cathodic sputtering chamber under vacuum. During a first stage, it undergoes ion bombardment with argon ions, so as to eliminate the last superficial traces of contaminant. The article is next negatively polarized to several tens of volts, and deposition of titanium by cathodic sputtering is begun. As the coating thickness grows, the electric polarization of this article is progressively increased, and an increasing flow of nitrogen is introduced into this chamber, so as to deposit a titanium nitride compound which is increasingly rich in nitrogen. At the end of the titanium nitride deposition, when the coating thickness reaches one micron, the polarization of the article may amount to a value lying between 150 and 250 volts, and the proportion of nitrogen atoms in the titanium nitride will be approximately 50%. The surface colour of the coating is then close to that of gold.

The next operation consists in bombarding the titanium nitride layer with argon ions. As the strength of this bombardment is decreased, a fine layer of gold is deposited by cathodic sputtering, with an increasing flux of gold atoms, until this layer attains a thickness of 0.1 micron. The watch case is then removed from the chamber. It is given the final surface colour by electroplating a coating of 0.3 micron of 22 carat gold alloy containing traces of indium and nickel, the color of which corresponds to the standard 2N 18.

According to another example, it is wished to deposit on the outer surface of a ball point pen tube of brass a fine layer of rhodium having good resistance to wear. After treating the surface by nickel electroplating, the article is introduced into the cathodic sputtering chamber where it undergoes the same treatment as in the previous example. During the deposition of titanium, nitrogen is replaced by a hydrocarbon, for example methane, so as to deposit a titanium carbide with an increasing proportion of carbon. Following the titanium carbide deposition, and simultanously with the ion bombardment of the surface, a thin silver layer is deposited by cathodic sputtering.

A last layer of rhodium is next electroplated on top of the silver until this layer attains a thickness of 0.3 micron.

Figure 2:
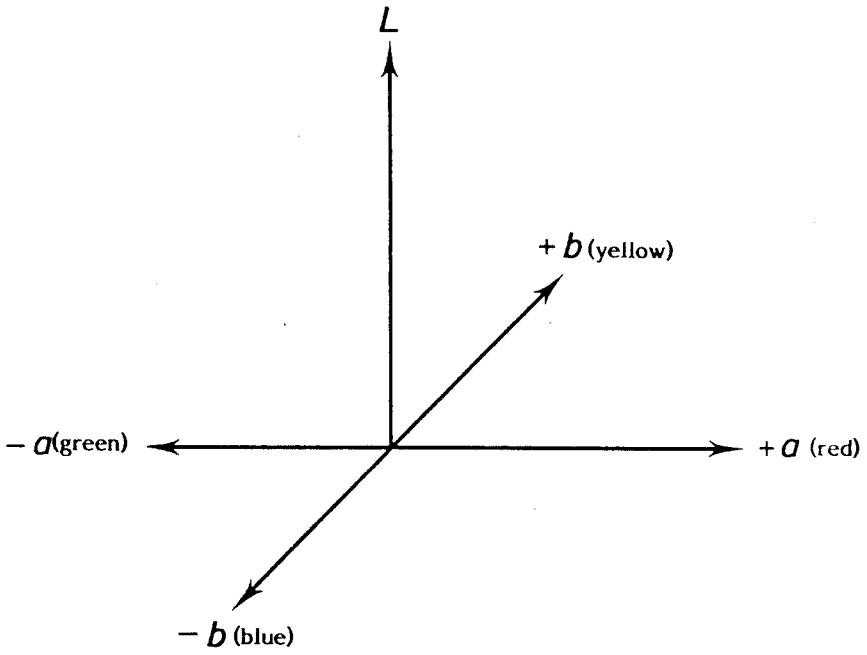
FIG. 2 illustrates the principle of colour measurement according to the standard of the International Lighting Commission CIE 1976.

FIG. 2 illustrates the principle of measurement of the colour of light reflected by the surface of an article according to the Standard CIE 1976 of the International Lighting Commission. Three variables are measured and correspond to three axes defining a three-dimensional orthogonal reference system. The axis L defines the brillance, the axis −a, +a corresponds to the two complementary colours green and red respectively. The axis −b, +b corresponds to the two complementary colours blue and yellow respectively.

Figure 3:
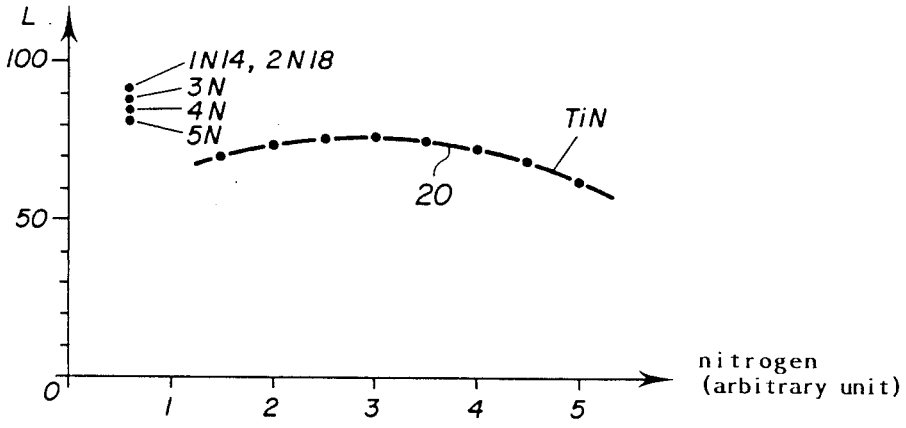
FIG. 3 is a graphical representation illustrating the brilliance of the coloured surface of a titanium nitride coating as a function of the amount of nitrogen it contains.

FIG. 3 represents a diagram of comparison between the brillance of titanium nitride and different standard gold alloys. In the ordinate, the brillance is represented in arbitary units and in the abscissa the nitrogen proportion entering into the titanium nitride composition, according to an arbitary unit. The brillance of the surface of a titanium nitride coating is represented by a curve 20. The brillance of different gold alloys is represented by a series of points. It is noted that the brillance of all the standard alloys represented is superior to all titanium nitride compounds.

Figure 4:
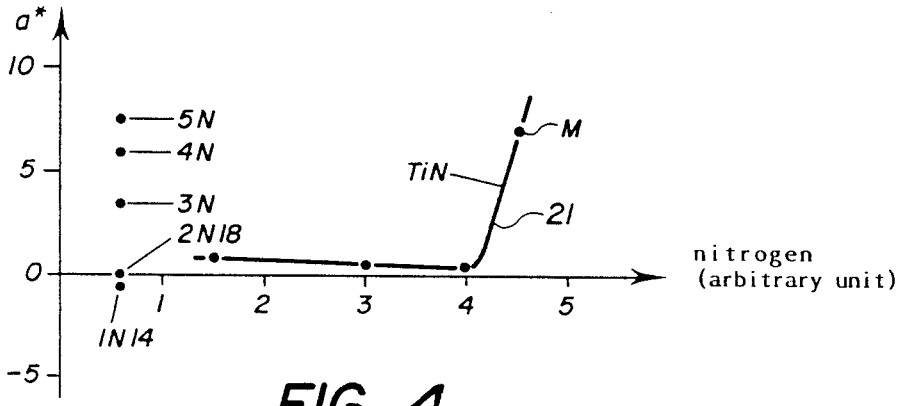
FIG. 4 illustrates the ratio of green and red colours reflected by a titanium nitride coating as a function of the amount of nitrogen it contains.

FIG. 4 represents the amount of green and red light reflected on one hand by a titanium nitride coating and on the other hand by different standard gold alloys. As before, the proportion of nitrogen in the titanium nitride compound plots the abscissa according to arbitary units. The curve 21 represents the amount of green and red light reflected by the titanium nitride coating.

Figure 5:
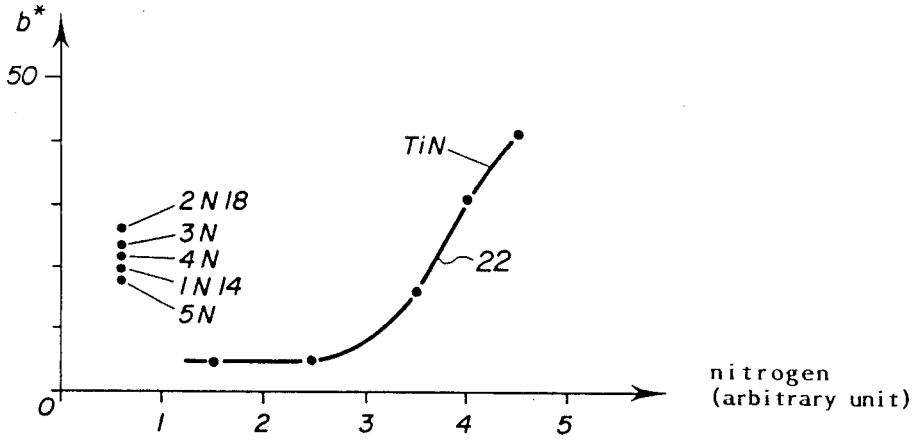
FIG. 5 represents the ratio of blue and yellow colours reflected by a titanium nitride coating as a function of the amount of nitrogen it contains.

FIG. 5 represents the amount of blue and yellow light respectively reflected by a titanium hydride coating and by various coatings of standard gold alloys. As before, the proportion of nitrogen contained in the titanium nitride plots the abscissa according to arbitrary units. Curve 22 represents the amount of blue and yellow light reflected by the titanium nitride coating as a function of its composition. The blue and yellow light reflected by the different alloys is represented by a series of points.

It is noted that whatever the nitrogen content of the titanium nitride may be, it is impossible to make a given standard alloy coincide exactly with a point of the curves representing titanium nitride. If one takes for example the alloy 5N, the nearest point M on the curve 21 corresponds to a titanium nitride whose nitrogen content lies between four and five while the nearest point on the curve 22 corresponds to a titanium nitride whose nitrogen content lies between three and four.

The same may be ascertained for the other standard gold alloys. Consequently, it is impossible to obtain a surface coating of titanium nitride which has exactly the appearance of a standard gold alloy, whence one of the main advantages of the described method.

It is clearly understood that the method is not limited to treatment of the articles described by way of example, but may be extended to various other articles which are purely decorative or to practical articles for which appearance is of great interest.

We claim:

1. Method of depositing a decorative wear resistant coating on a substrate, said substrate constituting at least a part of a decorative and/or utilitarian article, wherein during a first stage, ion bombardment of the substrate surface with gas ions is effected, vacuum deposition on the substrate surface is effected of a first layer of at least one metal selected from the group consisting of: titanium, zirconium, hafnium, vanadium, niobium, tantalum, chromium, molybdenum, tungsten and aluminum, to which at least one element is added which is selected from the group consisting of: carbon, nitrogen, oxygen, boron, silicon, fluorine, chlorine, sulfur, and phosphorus, said one element being added in an increasing amount so that the proportion of said one element in the fist layer increases as said layer is deposited, a negative polarization being applied to said substrate and a selected variation of compression stresses in said first layer being produced during said vacuum deposition by increasing the negative polarization of said substrate; wherein, during a second stage, said first layer is activated by ion bombardment under vacuum, and a second thin layer of a metal and/or metallic alloy is deposited, at least partly simultaneously with said ion bombardment; and wherein during a third stage, a third metallic coating layer having decorative properties and a desired color is electroplated on said second layer.

2. Method according to claim 1, wherein, during a first phase of said second stage, said first layer is subjected to ion bombardment without depositing metal and/or alloy having decorative properties, and during a second phase of said second stage, ion bombardment of said first layer is continued while simultaneously depositing a second thin layer of metal and/or alloy having decorative properties.

3. Method according to claim 2, wherein said ion bombardment is progressively reduced during said second phase of said second stage.

4. Method according to claim 2, wherein said second thin layer is deposited of at least one metal selected from the group consisting of: gold, platinum, palladium, rhodium, silver, iridium, osmium, rhenium, ruthenium and an alloy of gold with one of the elements of the group consisting of: indium, nickel, cobalt, cadmium, copper, silver, palladium, zinc, and antimony.

5. Method according to claim 2, wherein said second thin layer is deposited in a thickness between 100 and 10,000 Å.

6. Method according to claim 1, wherein during said third stage, said third layer is electroplated of at least one metal selected from the group consisting of: gold, platinum, palladium, rhodium, silver, iridium, osmium, rhenium, ruthenium and an alloy of one of these metals with at least one other metal, and of an alloy of gold with at least one of the elements of the group consisting of: indium, nickel, cobalt, cadmium, copper, silver, palladium, zinc, and antimony.

* * * * *

UNITED STATES PATENT AND TRADEMARK OFFICE

CERTIFICATE OF CORRECTION

PATENT NO. : 4,973,388

DATED : November 27, 1990

INVENTOR(S) : Francois Aubert and Bahman Miremad

It is certified that error appears in the above-identified patent and that said Letters Patent is hereby corrected as shown below:

TITLE PAGE:

Item [19] "Francois et al." should read "Aubert et al."

[75] Inventors: should read "Francois Aubert, Le Locle; Bahman Miremad, Neuchatel, both of Switzerland."

Signed and Sealed this

Twenty-first Day of July, 1992

*Attest:*

DOUGLAS B. COMER

*Attesting Officer*

*Acting Commissioner of Patents and Trademarks*